US005435639A

United States Patent [19]

Smits et al.

[11] Patent Number: 5,435,639

[45] Date of Patent: Jul. 25, 1995

[54] MODULAR RAIL FOR MOBILE FILING AND STORAGE SYSTEMS

[75] Inventors: Denis Smits, St-Hilaire; Jean-Pierre Lalonde, Verdun, both of Canada

[73] Assignee: MONTEL, Montmagny, Canada

[21] Appl. No.: 220,518

[22] Filed: Mar. 31, 1994

[51] Int. Cl.[6] ..... A47B 53/02

[52] U.S. Cl. ..... 312/201; 105/164

[58] Field of Search ..... 312/201, 204, 205, 249.8; 248/188.3; 105/164

[56] References Cited

U.S. PATENT DOCUMENTS

| | | | |
|---|---|---|---|
| 3,877,391 | 4/1975 | Gimperlein et al. | 105/164 |
| 3,967,868 | 7/1976 | Baker, Jr. | 105/164 |
| 4,053,129 | 10/1977 | Graff | 248/188.3 |
| 4,597,615 | 7/1986 | Steger | 312/201 |
| 4,616,888 | 10/1986 | Peterman | 312/201 |
| 4,708,411 | 11/1987 | Peterman | 312/201 |
| 4,911,507 | 3/1990 | Leist | 312/201 |
| 5,062,535 | 11/1991 | Potter | 312/201 |
| 5,205,627 | 4/1993 | Davison et al. | 312/201 |

*Primary Examiner*—Kenneth J. Dorner
*Assistant Examiner*—Rodney B. White
*Attorney, Agent, or Firm*—Joseph W. Molasky and Associates

[57] ABSTRACT

The disclosure herein describes a modular rail for use in the assembly of a mobile filing and storage system that includes cabinets each equipped with a roller carriage in their lower part. The rail is a longitudinal metallic extrusion that has a cross-section that defines a first open side section adapted to receive therein one side of a floor structure over which the system is mounted, an intermediate second section adapted to receive thereon roller members of the system carriage and a third section that consists of a first groove adapted to receive levelling bolts for vertically adjusting the extrusion relative to a floor on which the system is supported and a second groove adapted to removably receive a cover adapted to extend over the first groove. The cover is removed when the rail is used for expanding the system.

9 Claims, 5 Drawing Sheets

MODULAR RAIL FOR MOBILE FILING AND STORAGE SYSTEMS

FIELD OF THE INVENTION

The present invention relates to a modular rail for use in the assembly of mobile filing and storage systems that have cabinets each equipped with a roller carriage at their lower part.

BACKGROUND OF THE INVENTION

Present mobile filing and storage systems are assembled in place and, should there be a need to expand the number of filing cabinets, it then becomes necessary to disassembled the entire system in place and to install new rails to correspond to the new demand. Evidently, this is extremely time-consuming and expensive since the rails already in place cannot be re-used for the expanded system.

In certain cases, in order to avoid this problem and to foresee expansion, an assembly greater than that which is actually required is made resulting in unnecessary floor occupation and expenses.

OBJECTS AND STATEMENT OF THE INVENTION

It is an object of the present invention to overcome the above described problems of present systems.

This is achieved by providing a modular rail that allows the assembly to be expanded to greater floor area without the need of removing the rails already in place.

Hence, the present invention is a rail that is modular in that it is constructed in the manner that it can be used so as to fit to any additions to the filing and storage system, either in the longitudinal direction of movement of the cabinet or in a direction perpendicular to the latter.

The present invention therefore relates to a modular rail for use in the assembly of a mobile filing storage system that has cabinets equipped each with a roller carriage; the rail comprises a longitudinal metallic extrusion having a cross-section including:

a) a first section having an open side adapted to receive therein one side of a floor structure over which the filing and storage system is mounted, b) an intermediate second section contiguous with the first section adapted to receive thereon roller members of the roller carriage, and c) a third section contiguous with the second section consisting of i) first groove means adapted to receive therein levelling means for vertically adjusting the extrusion relative to a floor on which the filing and storage system is supported, and ii) second groove means adapted to removably receive a cover adapted to extend over the first groove means.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
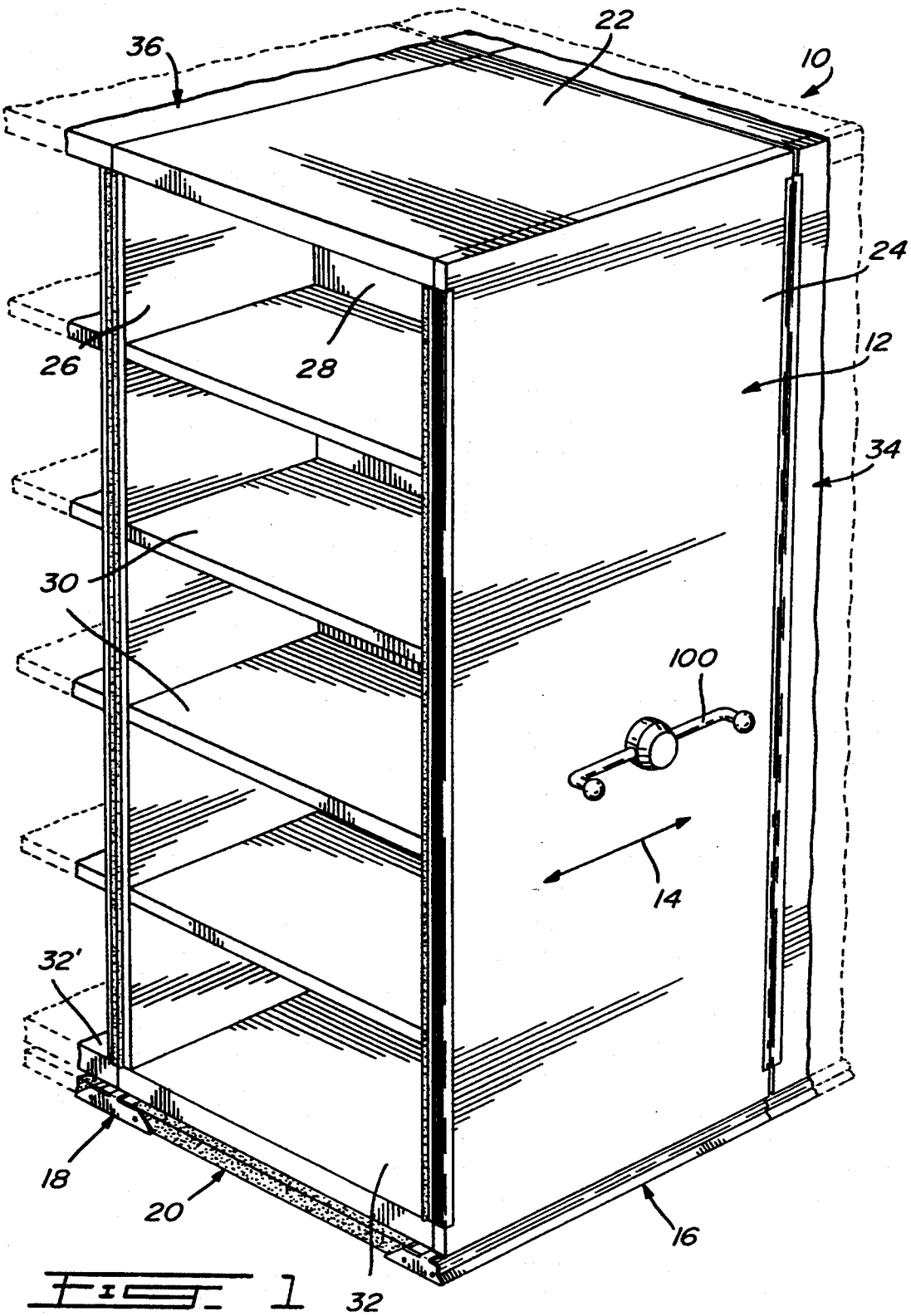
FIG. 1 is a perspective view of a mobile filing and storage system in which the present invention is used.

Referring to FIG. 1, there is shown a mobile filing and storage system, generally designated 10, that includes a filing cabinet 12 adapted to move longitudinally in the direction of arrow 14, the cabinet is supported and guided in a pair of parallel rail structures 16 and 18 mounted at opposite sides of a floor structure 20.

The filing cabinet 12 includes a top panel 22, two vertical side panels 24 and 26, a rear panel 28 and a series of vertically spaced shelves 30, the lower shelf 32 of which also acts as the roller carriage allowing the cabinet to be moved, manually, mechanically or electrically, along the rails. The detailed description of the roller carriage is made part of a co-pending patent application filed concurrently herewith by applicant.

FIG. 1 shows also parts of two adjacent panels 34 and 36 which, according to the present invention, may be added to the filing and storage system without the necessity of completely disassembling the various above described components of the filing system.

Figure 2:
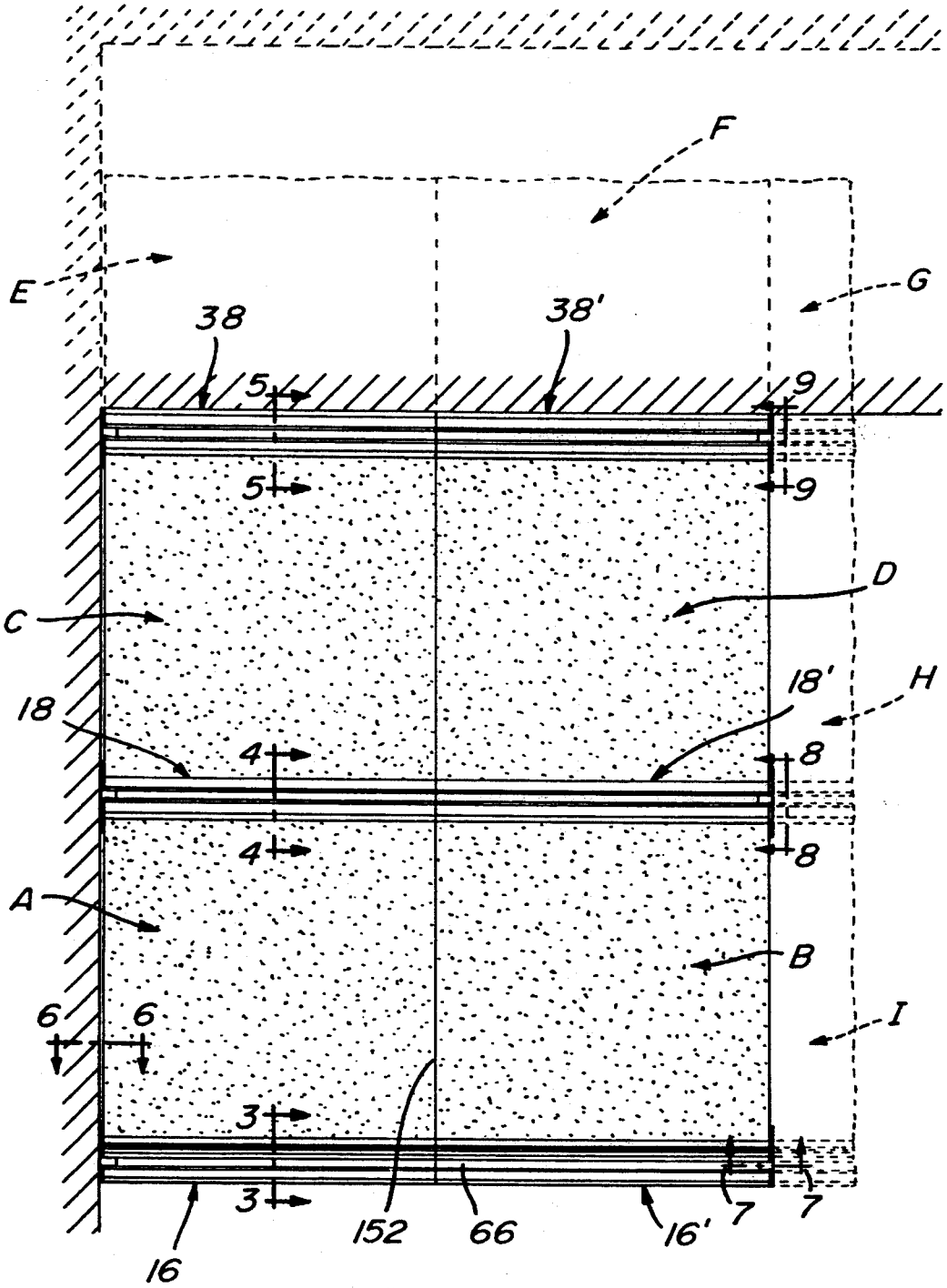
FIG. 2 is a schematic top plan view of a floor area to illustrate the modular feature of the present invention.

Referring to FIG. 2, the schematic representation illustrates the versatility of the present invention wherein, from a system that would include initially, for example, filing cabinets over floor areas A and C, it is possible to add cabinets over floor areas B and D as well as in areas E, F, G, H, I, in the latter case of which it would be required to add to rails 16, 18 and 38, three similar rail sections 16', 18' and 38'.

Figure 3:
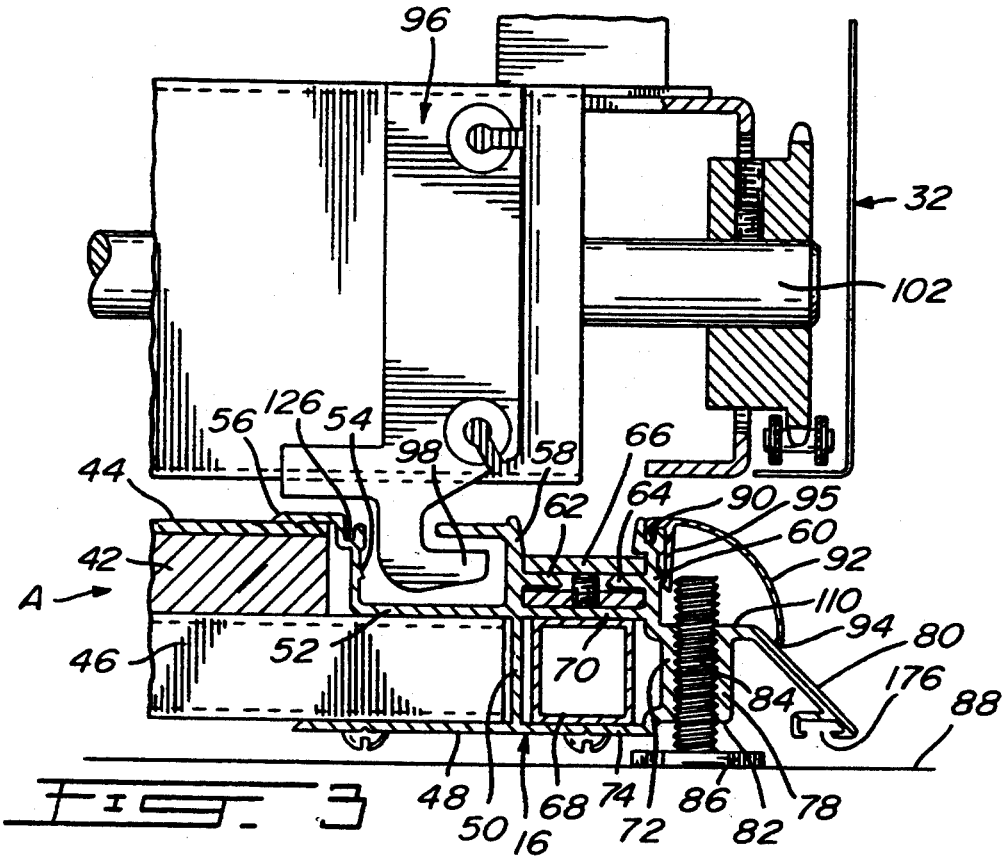
FIG. 3 is a cross-sectional view taken along lines 3—3 of FIG. 2 with the addition of part of a roller carriage.
Figure 4:
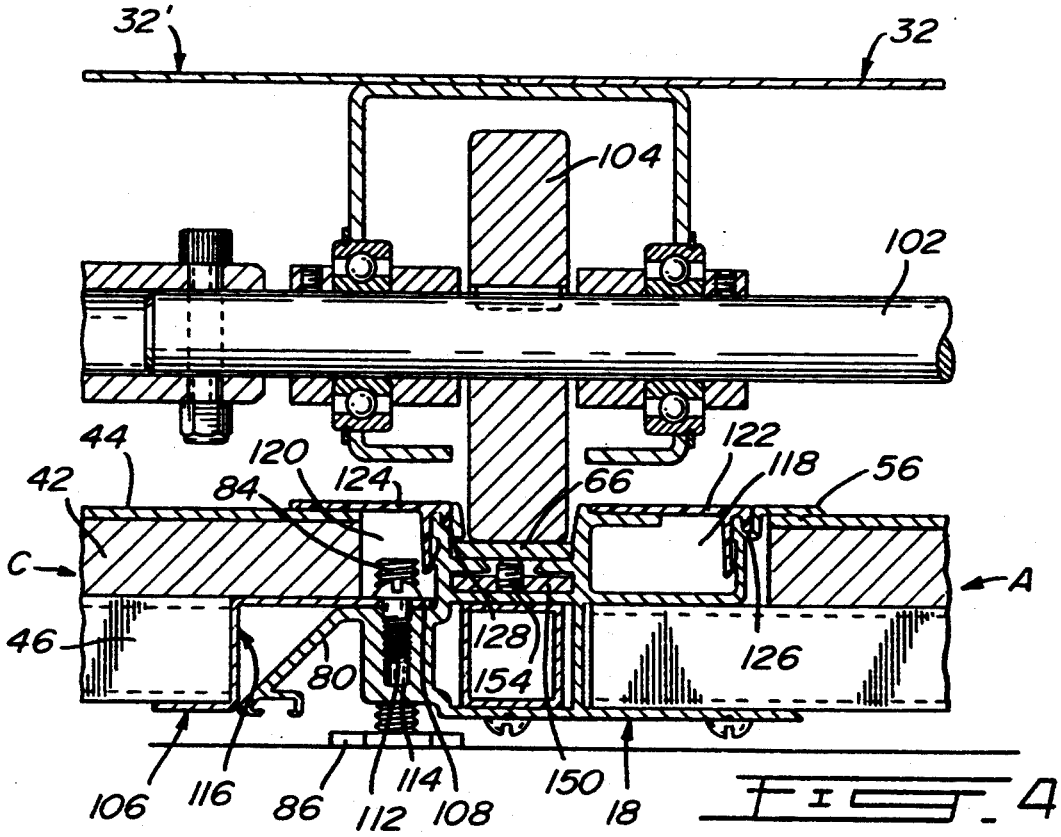
FIG. 4 is a cross-sectional view taken along lines 4—4 of FIG. 2 with the addition of part of a roller carriage.
Figure 5:
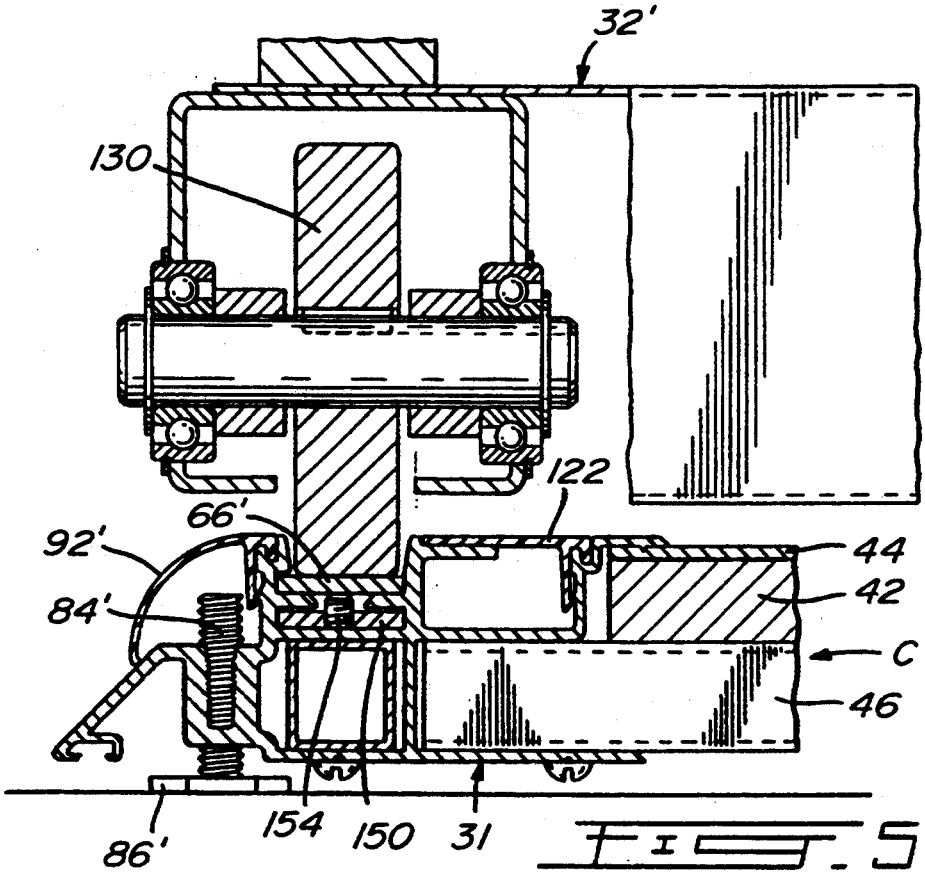
FIG. 5 is a cross-sectional view taken along lines 5—5 of FIG. 2 with the addition of part of a roller carriage.
Figure 6:
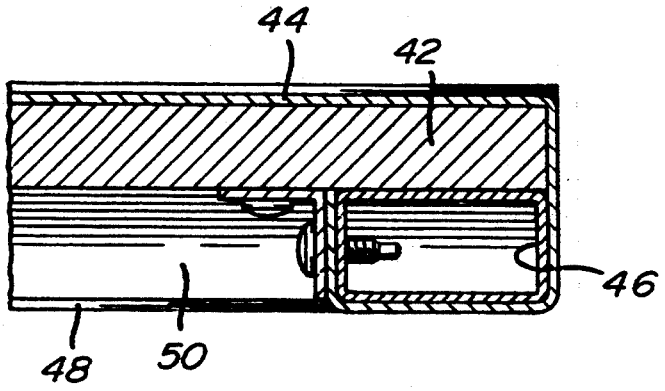
FIG. 6 is a cross-sectional view taken along lines 6—6 of FIG. 2.

FIGS. 3, 4 and 5 are cross-sectional views taken from FIG. 2 with the addition, however, of part of the lower roller carriage in order to better illustrate the purpose of the present invention. Referring also to FIG. 6, a floor structure usually includes a rectangular panel 42 of plywood covered with a carpet 44 and supported by a series of laterally spaced longitudinal metallic tubular structures 46.

Each modular rail structure 16, 18, 38 of the present invention consists essentially of a longitudinal metallic extrusion comprising a first end section formed of walls 48, 50 and 52 which receive the ends of the metallic tubular structures 46 and of two additional walls 54 and 56 which receive the plywood panel 42 with its carpet 44. Contiguous with the first end section, is an intermediate second section or central section consisting of vertical walls 58 and 60, each having opposite inward horizontal extensions 62 and 64, respectively, thus defining a U-shaped recess into which a roller bearing plate 66 is slidably received and supported. The lower part of this second rail section encloses a tubular member 68 which serves as a reinforcement for the closed channel formed by side wall 50 of the first section, top wall 70 of the upper recess, side wall 72 and bottom wall 74, the latter being an extension of the bottom wall 48 of the first section.

The rail further includes a third or opposite end section which is contiguous with said intermediate second section and which consists essentially of a first groove means and a second groove means. The first groove means is adapted to receive a leveling means for vertically adjusting the metallic extrusion relative to the floor on which the system is supported and the second groove means is adapted to removably receive a cover adapted to extend over said first groove means. Structurally, this opposite end section which includes the side wall 60 of the second section, a U-shaped groove defined by side wall 72 of the second section and opposite side wall 78 from which extends an outwardly inclined ramp 80. The groove formed by opposite side walls 72 and 78 displays a series of longitudinal parallel ribs while the bottom wall 82 is tapped with a hole so as to receive therethrough the threaded stem 84 of a levelling bolt 86, the head of which rests on floor 88. The upper edge of wall 60 is grooved so that a flange 90 of a flexible cover 92 may be snapped or slid into engagement to hide and protect the groove into which are mounted the levelling bolts 84. The lower edge 94 of the cover rests on ramp 80. The cover has a projecting flange 95 which further secures it in place.

A further section of the rail is formed of walls 52, 54 and 58 into which may fit an anti-tilt device 96 secured to the roller carriage and having a portion 98 extending into the said further section.

As shown in FIG. 4, carriage 32 has rollers, one of which is indicated at 104, mounted to a shaft 102 which is rotated by operating handle 100 (see FIG. 1) to which it is appropriately connected. These rollers are supported on plate 66. The opposite side of the floor structure A is received within the rail structure 18 which is constructed identically to the rail structure 16 described above and illustrated in FIG. 3. Whenever it is desired to add filing cabinets in other areas such as B and D, a slightly modified floor structure C is used in which one extremity of the floor is identical to the sides of floor structure A while the other side is constructed as illustrated in FIG. 4 with a section 106 which has an extension 108 that projects beyond the plywood 42 and rests on the upper face 110 (see FIG. 3) of the rail structure. This extension 108 has proper openings allowing a series of longitudinally spaced screws 112 to fit into the U-shaped groove 114 and to secure the floor structure to the rail. A recessed area 116 in the bracket 106 permits location of the ramp 80 therein. To prevent dust from entering the two chambers 118 and 120, similarly constructed flexible covers 122 and 124 are snapped in their respective grooves 126 and 128 of the rail.

FIG. 5 shows a roller 130 mounted at the opposite end of the lower carriage 32' of the filing cabinet 36, the roller being supported on plate 66' received within a rail 31 which is identically shaped to rails 16 and 18 described above. The opposite side of the floor structure C is constructed identically to the sides of panel of floor area A. In this case, a cover 92' is used to hide and protect the area of the longitudinal groove in which the levelling means 84', 86' extend.

Referring to FIG. 2, whenever it is wished to add file cabinets in floor areas B and D, rails 16', 18' and 38? are positioned to abut the ends of rails 16, 18 and 38, respectively. In order to ensure a tight connection between the respective rails, a plate 150 is positioned within a channel located underneath the recess in which plate 66 is supported. This plate 150 extends between the intersecting line 152 (see FIG. 2) and is secured therein by means of a fastening screw 154; its opposite ends are bevelled so as to match with the bevelled ends of plate 66 thereby avoiding an intersecting line perpendicular to the travel of the roller.

Figure 7:
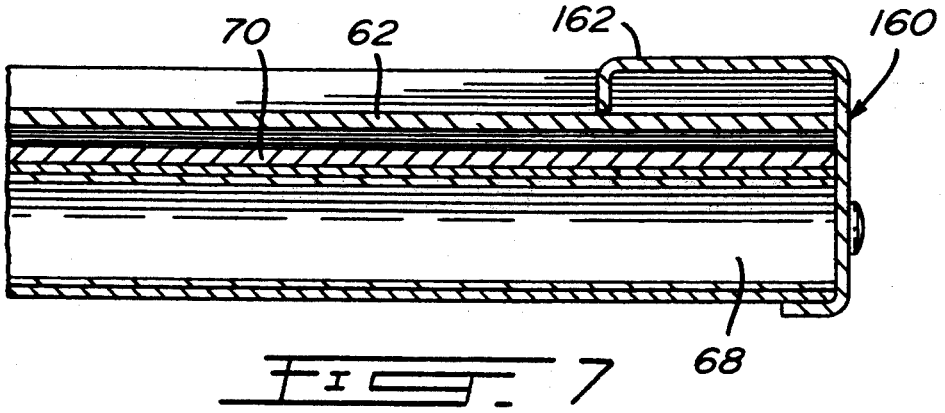
FIG. 7 is a cross-sectional view taken along lines 7—7 of FIG. 2.
Figure 8:
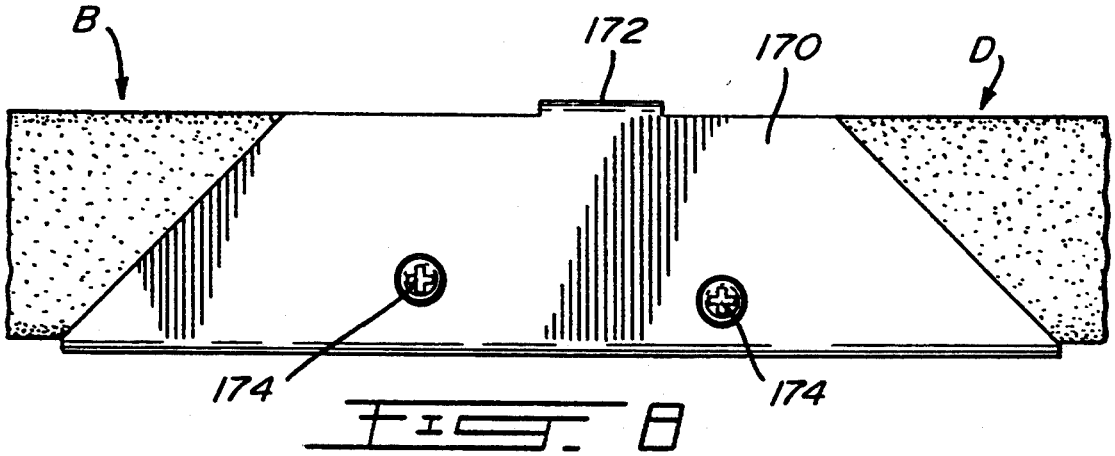
FIG. 8 is an end view as seen from lines 8—8 of FIG. 2.
Figure 9:
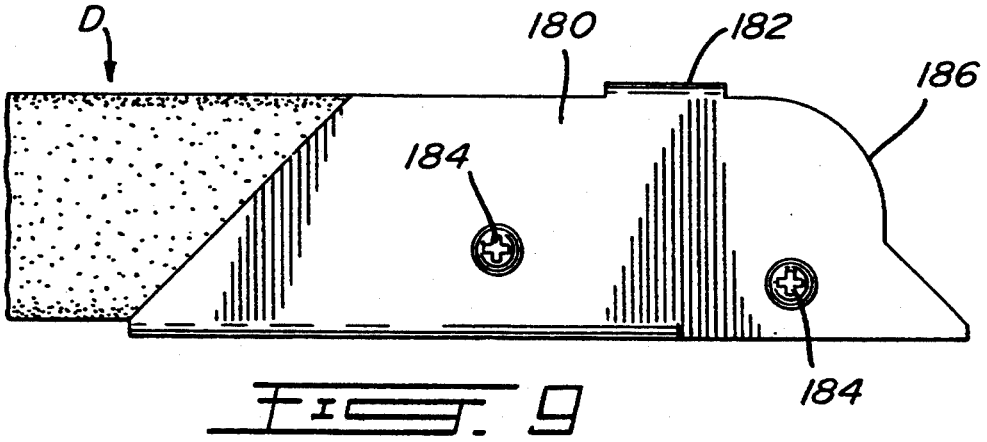
FIG. 9 is an end view as seen from lines 9—9 of FIG. 2.

FIGS. 7, 8 and 9 represent the components used at the extremities of rails 16', 18' and 38' respectively. In FIG. 7, the end plate 160 has an upper inwardly projecting part 162 that serves as a stopper for the roller when rolling on plate 66.

FIG. 8 shows the end plate 170 with its upper inwardly projecting part 172 having a stopper function similar to that of 162 in FIG. 7. Screws 174 secure the plate 170 by engaging corresponding slots 176 (see FIG. 3) at the lower part of the ramp 80.

FIG. 9 also shows an end plate 180 with a stopper 182 and fastening screws 184. This end plate displays a curved portion 186 that conforms with the curved portion 92 of the flexible cover.

Although the invention has been described above in relation to one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A modular rail for use in the assembly of a mobile filing and storage system having cabinets each equipped with a roller carriage, comprising a longitudinal metallic extrusion having a cross-section defining:

a) an end section having an open side adapted to receive one side of a floor structure over which said filing and storage system is mounted, b) an intermediate second section contiguous with said first section adapted to receive thereon roller members of said carriage, and c) an opposite end section contiguous with said second section consisting of i) first groove means adapted to receive therein levelling means for vertically adjusting said extrusion relative to a floor on which said filing and storage system is supported, and ii) second groove means adapted to removably receive a cover adapted to extend over said first groove means.

2. A modular rail as defined in claim 1, wherein said first groove means consist of a longitudinal U-shaped groove.

3. A modular rail as defined in claim 2, wherein said U-shaped groove includes opposite side walls displaying a series of longitudinal parallel ribs.

4. A modular rail as defined in claim 2, wherein said third section includes an inclined ramp adjacent said U-shaped groove.

5. A modular rail as defined in claim 1, wherein said second groove means consist of a longitudinal U-shaped groove located at an upper part of said third section.

6. A modular rail as defined in claim 1, wherein said second section includes a recessed area having support means therein adapted to slidably and longitudinally receive a roller bearing plate.

7. A modular rail as defined in claim 6, wherein said recessed area further includes a channel located below said support means to slidably receive therein a connecting plate when two similarly-constructed rail structures are disposed adjacent to one another.

8. A modular rail as defined in claim 1, further comprising an open channel section disposed between said first and said second sections and adapted to receive a tilt refraining device mounted on said roller carriage.

9. A modular rail as defined in claim 8, wherein said channel section includes groove means at an upper portion thereof to slidably receive therein a cover to close said open channel section when a tilt refraining device is not utilized.

* * * * *